US007134556B1

(12) United States Patent
McCauley

(10) Patent No.: US 7,134,556 B1
(45) Date of Patent: Nov. 14, 2006

(54) PORTABLE ORE WASHER

(76) Inventor: Larry W. McCauley, 205 6th Ave. West, Kalispell, MT (US) 59901

( * ) Notice: Subject to any disclaimer, the term of this patent is extended or adjusted under 35 U.S.C. 154(b) by 343 days.

(21) Appl. No.: 10/860,176

(22) Filed: Jun. 3, 2004

Related U.S. Application Data

(60) Provisional application No. 60/475,609, filed on Jun. 4, 2003.

(51) Int. Cl.
*B03B 5/02* (2006.01)

(52) U.S. Cl. ..... 209/507; 209/444; 209/453

(58) Field of Classification Search ..... 209/434, 209/444, 506, 507, 453, 236, 254, 498
See application file for complete search history.

(56) References Cited

U.S. PATENT DOCUMENTS

| | | | | | |
|---|---|---|---|---|---|
| 6,267 | A | | 3/1849 | Jennison | |
| 6,763 | A | | 10/1849 | Jenks | |
| 118,437 | A | * | 8/1871 | Gollom | 209/444 |
| 152,044 | A | * | 6/1874 | Patton | 209/191 |
| 162,809 | A | * | 5/1875 | Evans | 209/444 |
| 184,622 | A | * | 11/1876 | Hooper | 209/465 |
| 286,342 | A | * | 10/1883 | Stirk | 209/445 |
| 463,482 | A | | 11/1891 | Clark | |
| 552,995 | A | * | 1/1896 | Frey | 209/44 |
| 594,255 | A | | 11/1897 | Kahn | |
| 810,894 | A | * | 1/1906 | Viser | 209/277 |
| 942,663 | A | | 12/1909 | Rachelman | |
| 1,443,608 | A | | 1/1923 | Bleakley | |
| 2,964,188 | A | | 12/1960 | Evans et al. | |
| 4,148,725 | A | | 4/1979 | Haight | |
| 4,271,011 | A | * | 6/1981 | Spencer et al. | 209/236 |
| 5,447,239 | A | | 9/1995 | Tubbs, Jr. | |
| 5,788,293 | A | | 8/1998 | Krenzler | |

* cited by examiner

*Primary Examiner*—Eileen D. Lillis
*Assistant Examiner*—Kaitlin Joerger
(74) *Attorney, Agent, or Firm*—Richard C. Conover

(57) ABSTRACT

A circular tray having an upper surface shaped to incline downwardly from a center to an outer circumference. The tray including annular grooves for collecting gold. A crank is connected to the tray for rotating the tray. The tray is supported with a stand having at least one elongate arm extending radially across the tray above the tray in spaced apart relation thereto. Multiple loops of a line material are attached in spaced apart depending relation along the elongate arm in such a way that the bottom portion of the loop extends in a direction which is oblique with the elongate arm. Each loop is sized to have the bottom portion resting in close proximity with the upper surface of the tray so that when the tray is rotated, the loops mechanically move ore across the surface of the tray from the center to the outer periphery.

3 Claims, 5 Drawing Sheets

PORTABLE ORE WASHER

This application claims the benefit of provisional application Ser. No. 60/475,609, filed Jun. 4, 2003.

BACKGROUND OF THE INVENTION

The present invention relates to a portable ore washer having a gold panning tray which may be rotated by turning a hand crank. As the ore is moved outwardly across the tray, gold settles into grooves provided in the tray.

Ore washers having a rotatable gold panning tray are known, such as shown in U.S. Pat. No. 6,763 to Jenks. Another type of a portable gold washer is shown in U.S. Pat. No. 594,255 to Kahn. These ore washers, and others known in the art, all use centrifugal force to move the ore across a gold panning tray for collecting gold. The present invention is an improvement over the known ore washers because it provides an apparatus for mechanically moving the ore across the rotating gold panning tray in order to separate the gold from the ore.

SUMMARY OF INVENTION

The present invention is used by submersing a gold panning tray in water. A crank is used to rotate the gold panning tray underneath a series of arms having depending line segments which physically move the ore across the face of the tray. The tray is provided with a series of annular grooves which collect the gold as the ore is being moved across the tray.

The present invention includes a circular gold panning tray having an upper and lower surface. The upper surface of the gold panning tray is shaped to incline downwardly from a center to an outer circumference. The upper surface of the gold panning tray is provided with multiple, radially spaced apart, annular grooves located on the upper surface. A crank shaft is connected to the gold panning tray for rotating the tray upon rotation of the crank shaft. The gold panning tray is supported with a stand having at least one elongate arm extending radially across the gold panning tray above the tray in spaced apart relation thereto. The elongate arm is positioned to extend from the axis of rotation of the tray to a distance beyond the outer circumference of the tray. Multiple loops of a line material are attached in spaced apart relation along the longitudinal axis of the elongate arm in such a way that the bottom portion of the loop extends toward the tray and in a direction which is oblique with the longitudinal axis of the elongate arm. Further, the loops are arranged in parallel relation. Each loop is sized to have the bottom portion resting in close proximity with the upper surface of the gold panning tray so that when the tray is rotated, the loops mechanically move the ore across the surface of the tray from the center to the outer periphery.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
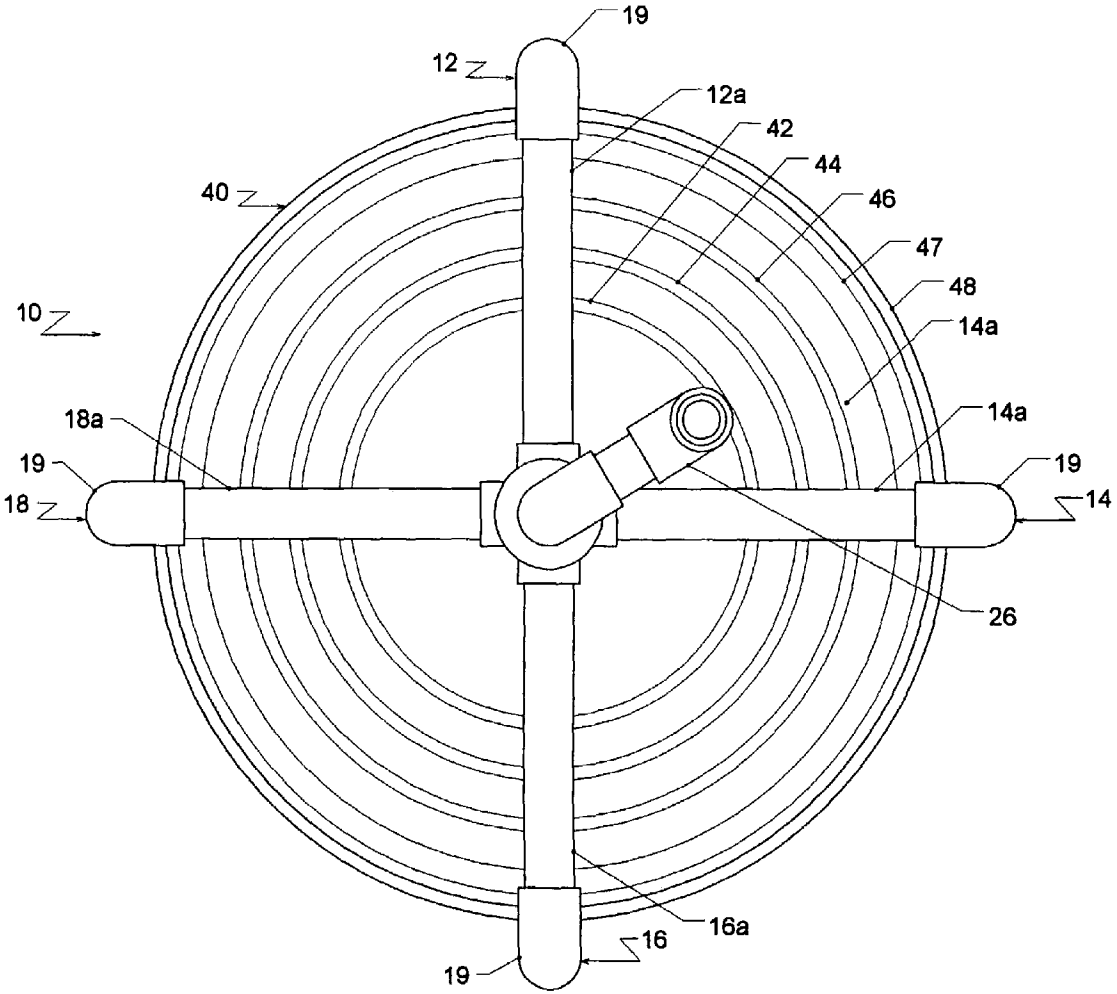
FIG. 1 is a top plan view of a ore washer according to the present invention.
Figure 2:
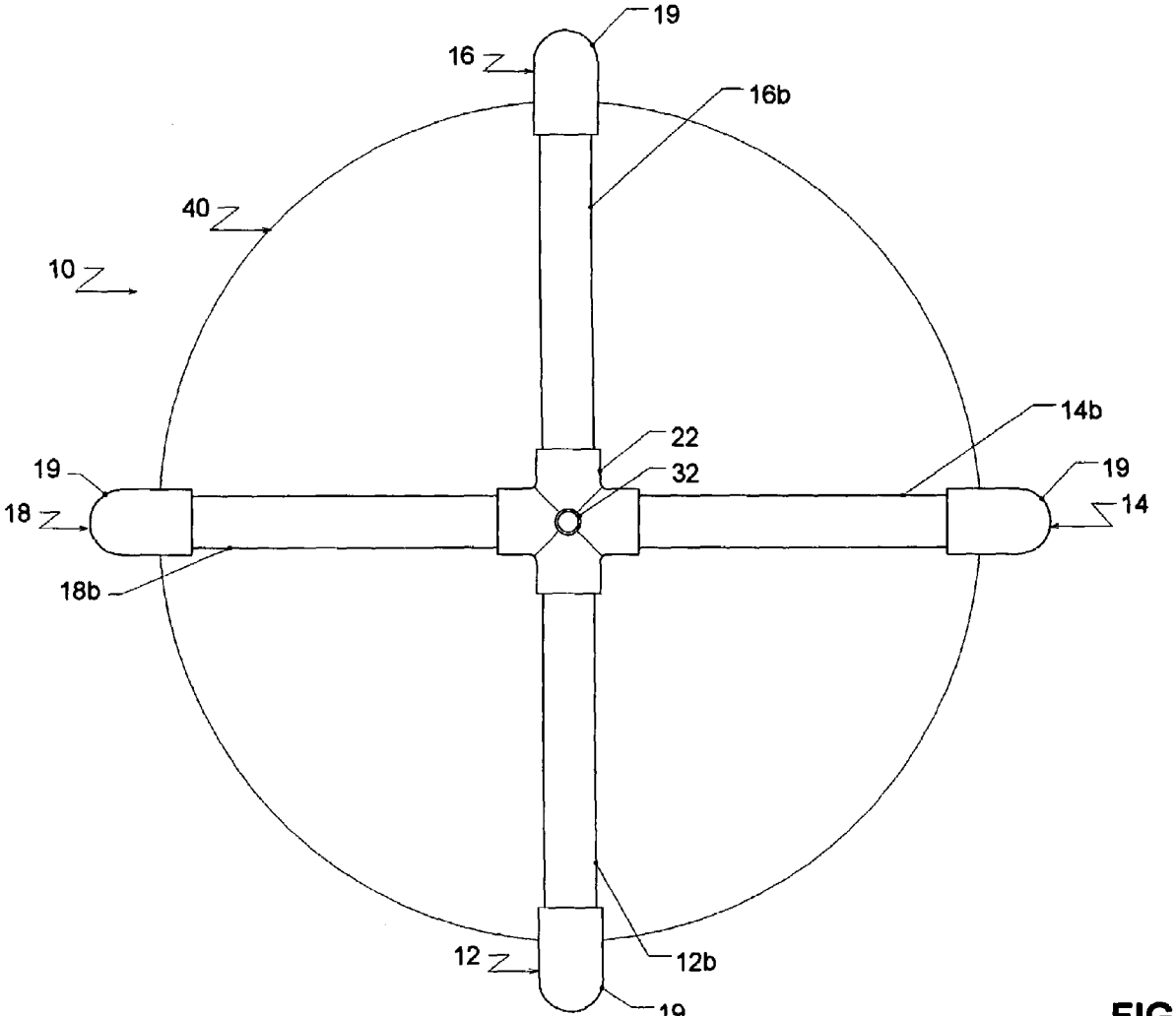
FIG. 2 is a bottom plan view of the ore washer shown in FIG. 1.
Figure 3:
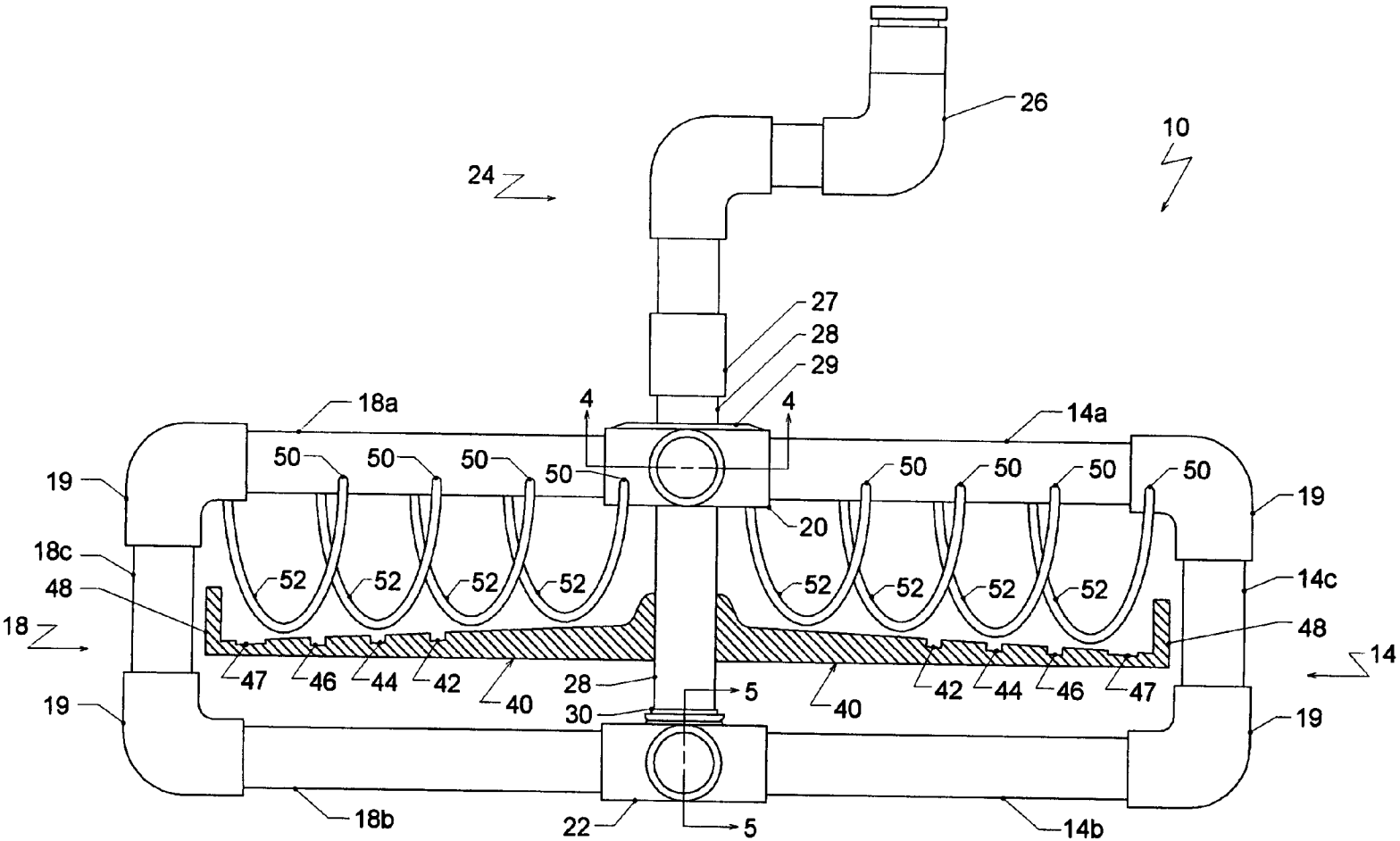
FIG. 3 is a side elevational view of the ore washer shown in FIG. 1 partially in cross-section and with parts removed.

A gold panning tray 10 according to the present invention is shown in FIGS. 1–3. The gold panning tray 10 includes a stand having four squared "U"-shaped legs 12, 14, 16 and 18. Each leg has a horizontally-positioned upper arm 12*a*, 14*a*, 16*a* and 18*a*, respectively, and a horizontally-positioned lower leg 12*b*, 14*b*, 16*b* and 18*b*, respectively. The upper arms and lower legs are joined by upright end members 12*c*, 14*c*, 16*c* and 18*c*. In a preferred embodiment, the stand is constructed of PVC pipe where the end members 12*c*, 14*c*, 16*c* and 18*c* are joined to their respective upper arm and lower leg portions with 90° PVC couplers 19. A view showing the leg members 14 and 18 is shown in FIG. 3. The other leg members 12 and 16 are constructed in a similar manner. It is contemplated that other supporting stand structures could be used equally as well.

The upper arms 12*a*, 14*a*, 16*a* and 18*a* are joined together at a center with a PVC 4-way coupler 20, as shown in FIGS. 1 and 3. The bottom legs are joined together with a second PVC 4-way coupler 22, as shown in FIGS. 2 and 3.

Figure 4:
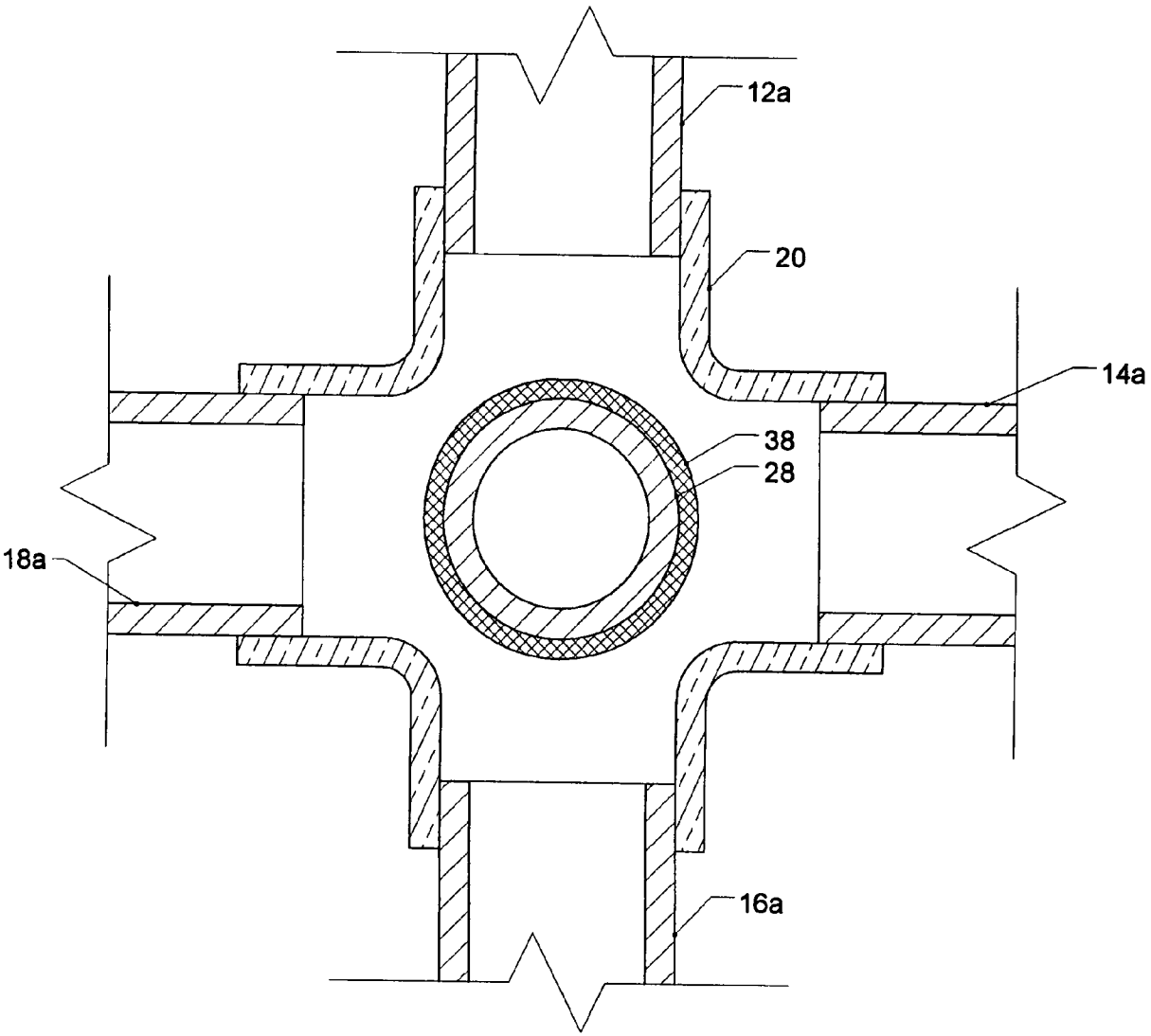
FIG. 4 is a cross-sectional view taken along the line 4—4 in FIG. 3.
Figure 5:
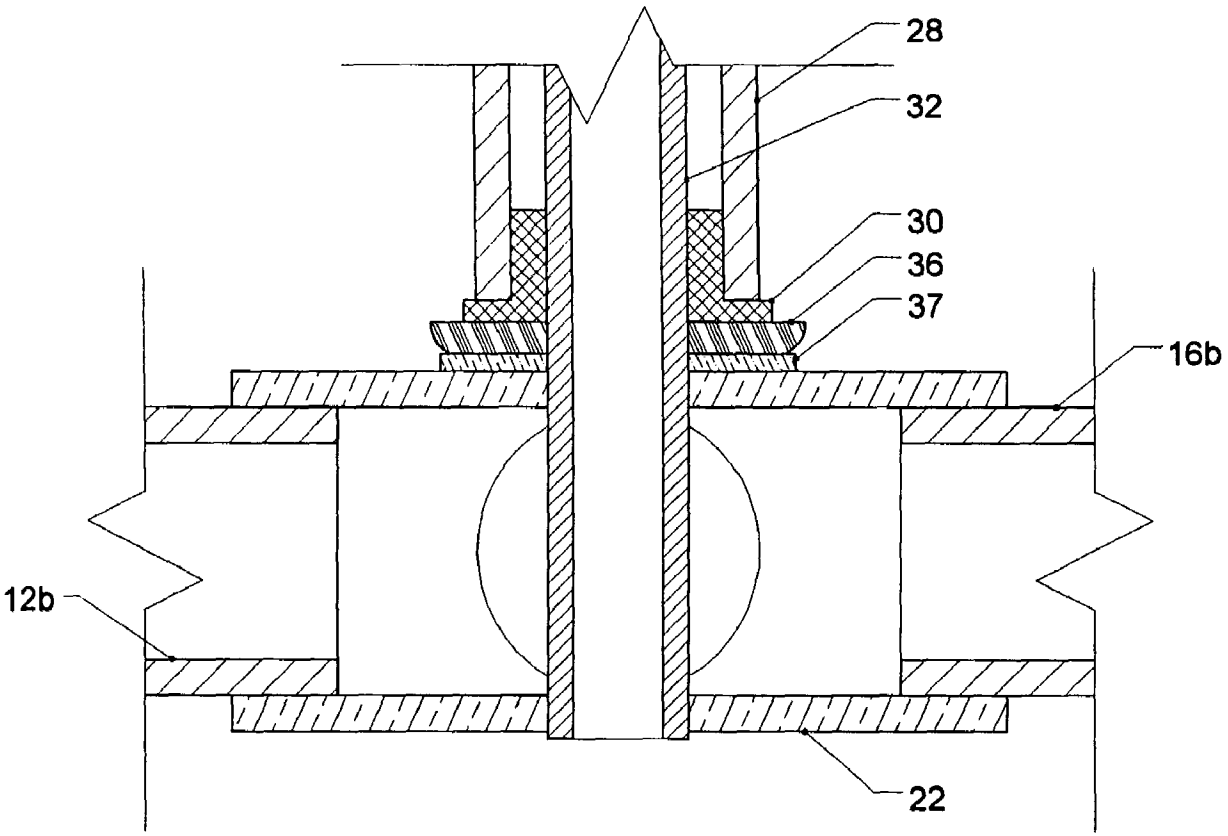
FIG. 5 is a cross-sectional view taken along the line 5—5 in FIG. 3.

The gold panning tray 10 further includes a hand crank 24 having a crank handle 26 constructed as shown in FIG. 3. In a preferred embodiment, the crank handle is constructed of PVC pipe and pipe couplers in a conventional manner, as shown in FIG. 3. Other crank handles could be used equally as well. The crank handle 26 includes a straight pipe coupler 27 for receiving and frictionally holding a tubular crank shaft 28, as shown in FIG. 3. The tubular crank shaft 28 is positioned to slidably extend through bushing 38 provided in cross coupler 20, as shown in FIG. 4. A dust cap 29 is provided on top of bushing 38, as shown in FIG. 3. The distal end of the tubular crank shaft 28 is secured to a reducer member 30 with PVC cement, as shown in FIGS. 1 and 5. A tubular guide member 32 has one end extending through a bore provided in reducer 30, as shown in FIG. 5, and into tubular crank shaft 28. The other end of guide member 32 extends through a bore 34 provided in cross coupler 22. The bore 34 is sized to frictionally secure guide member 32 within the bore 34. A pair of flat washers 36 and 37 are provided between reducer 30 and the cross coupler 22, as shown in FIG. 5. With this construction, the crank shaft 28 is allowed to revolve around tubular guide 32 by turning the crank handle 26.

A generally circular gold panning tray 40 includes a central hub 41 which in turn is secured to crank shaft 28 as with epoxy cement so that the tray 40 rotates by turning crank handle 26. The tray 40 in constructed to have an inclined upper surface extending downwardly from the crank shaft to the outer periphery, as shown in FIG. 3. The tray 40 includes a plurality of annular grooves 42, 44, 46 and 47 for catching gold as it is being washing on the tray 40. A circumferential retaining lip 48 is provided on the tray, as shown in FIGS. 1 and 3.

As shown in FIGS. 1 and 3, the arms 12*a*, 14*a*, 16*a* and 18*a* are positioned to radially extend across the tray 40 from a center to beyond the circumference of the tray. Further, the arms 12*a*, 14*a*, 16*a* and 18*a* are located above the tray 40 in spaced apart relation.

As shown in FIG. 3, the upper arms 12*a*, 14*a*, 16*a* and 18*a* are provided with a series of perforations 50 for receiving segments of trimmer line 52. Each segment of trimmer line 52 is formed into a loop and the ends of the segment secured in appropriate perforations 50, as with a friction fit or with cement. Each loop has one end of the line segment secured to the respective upper arm at a position closer to the center than the other end. Further, each loop has one end of the line segment attached to one lateral side of the elongate arm and the other end attached to the opposite side of the elongate arm, as shown in FIG. 3. With this construction, each loop has a bottom portion which extends in a direction oblique to the longitudinal axis of the respective arm. Further, the loops are arranged on each arm so that the bottom portions of the loop are in parallel relation, as shown in FIG. 3. Each loop is sized to have a bottom portion which rests in close proximity with the upper surface of the tray 40, as shown in FIG. 3. In a preferred embodiment, the bottom portion has a clearance of approximately 1/32" to 1/8". When the tray is revolved, the trimmer lines aid in moving the gravel or sand on the tray 40 to the outer periphery of the tray.

In operation, gold-bearing gravel or sand is placed on the tray 40 of the gold panning tray 10. The tray is placed in water with the tray submerged. The hand crank 24 is then rotated causing the gravel or sand to be distributed outwardly aided by the trimmer lines 52. The heavier gold metal settles in the grooves 42, 44, 46 and 47 upon spinning the tray. The lighter gravel and sand is moved outwardly and over the lip 48. In this manner, individuals can process substantial amounts of gold-bearing sand and gravel to collect gold on the tray.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims:

I claim:

1. An ore washer comprising:

a planar, generally circular, gold panning tray with an upper and lower surface;

the upper surface of the gold panning tray shaped to incline downwardly from a center to an outer circumference;

the gold panning tray having an upwardly extending lip located around the circumference;

the gold panning tray having multiple, radially spaced apart, annular grooves located on the upper surface;

the gold panning tray having a hub located at the center with the hub having an axis of rotation extending generally perpendicular to the gold panning tray;

a crank shaft, having a longitudinal axis, fixedly secured to the hub with the longitudinal axis aligned with the axis of rotation of the hub for rotating the gold panning tray upon rotation of the crank shaft;

a stand for supporting the gold panning tray;

the crank shaft rotatably mounted to the stand;

the stand having at least one elongate arm extending radially across the gold panning tray above the tray in spaced apart relation with the tray from the axis of rotation of the tray to beyond the lip;

each elongate arm having a longitudinal axis;

multiple trimmer line segments on each arm;

each trimmer line segment having one end attached in depending relation to an elongate arm at a position closer to the center than the other end and also having one end attached to one lateral side of the elongate arm and the other end attached to the opposite lateral side of the elongate arm thereby forming a loop having a bottom portion extending toward the gold panning tray and in an oblique relation with the longitudinal axis of the elongate arm;

each loop attached to the elongate arm in spaced apart relation along the longitudinal axis of the elongate arm;

the multiple loops on each arm arranged in parallel relation; and each loop sized to have the bottom portion resting in close proximity with the upper surface of the gold panning tray.

2. The ore washer according to claim 1 wherein four elongate arms are provided and each elongate arm positioned to extend in a direction perpendicular to the longitudinal axes of adjacent elongate arms.

3. The ore washer according to claim 1 further including a crank handle attached to the crank shaft.

* * * * *